US005212921A

United States Patent [19]

Unruh

[11] Patent Number: 5,212,921

[45] Date of Patent: May 25, 1993

[54] DOOR SILL COMPOSITION

[75] Inventor: Kirby L. Unruh, Warroad, Minn.

[73] Assignee: Marvin Lumber and Cedar Company, Warroad, Minn.

[21] Appl. No.: 950,790

[22] Filed: Sep. 24, 1992

[51] Int. Cl.[5] ..... E06B 1/04

[52] U.S. Cl. ..... 52/204.1; 49/504

[58] Field of Search ..... 49/DIG. 1, DIG. 2, 504; 52/97, 204, 209, 211, 309.14, 731

[56] References Cited

U.S. PATENT DOCUMENTS 3,634,992 1/1972 Hughes .
4,724,597 2/1988 Johnson .
4,791,771 12/1988 Haugaard et al. .
4,924,631 5/1990 Davies et al. .

FOREIGN PATENT DOCUMENTS 1442211 7/1976 United Kingdom ..... 52/212

*Primary Examiner*—Carl D. Friedman
*Assistant Examiner*—Creighton Smith
*Attorney, Agent, or Firm*—Lawrence M. Nawrocki

[57] ABSTRACT

An improved door sill construction. The sill includes a core including a form made from spun class fibers treated with a polyester resin. The spun glass fibers are oriented in both lineal rows and random mats in order to maximize strength. The sill further includes a cladding coating the form which is stable to ultraviolet radiation.

2 Claims, 1 Drawing Sheet

DOOR SILL COMPOSITION

This is a continuation of copending application Ser. No. 07/642,358 filed on Jan. 17, 1991 now abandoned.

TECHNICAL FIELD

The present invention deals broadly with doors providing access to a building such as a residential dwelling. More specifically, however, the invention deals with sills for sliding doors such as doors to patios, decks, etc. The specific focus of the invention is the overall composition of a sill for such a door.

BACKGROUND OF THE INVENTION

Sliding doors such as ones providing egress, for example, from a residential dwelling to a patio or deck are well-known in the prior art. Such prior art is fairly well developed. Sliding doors having been in existence for a considerable period of time. Typically, such doors, which are known as French doors, are utilized to provide access, as indicated above, to patios, decks, etc. from residences with which such patios, decks, etc. are associated.

Of serious concern in the manufacture of doors in general and, particularly, sliding doors, is the sill structure. The sill is the portion which provides the threshhold over which one passes when passing through the door closure.

In the case of sliding doors, sills provide unique problems. They must be resistent to chemical action which might result from exposure to ultraviolet light. Additionally, they must be strong and durable, since traffic across them can be quite significant.

In the prior art, various materials have been employed in the manufacture of sliding door sills. Wood is one particular composition which has been employed. Wood, however, decays over a period of time, since wood absorbs moisture. Even when decay is slow so that the useful life of a sill is obtained, warping can occur. Warping, if significant enough, can create a safety hazard. At a minimum, however, it gives rise to an unsightly condition.

Aluminum has been deemed to be a logical choice for a sliding door sill application. Aluminum has been thought to have the most significant strength for this application. Stronger materials would, of course, be more desirable.

Even aside from the strength issue, however, aluminum does have certain drawbacks. Because of its inherent metallic properties, aluminum has a relatively high coefficient of thermal conductivity. When used in a sliding door sill application, aluminum can conduct heat within the building in which the door is installed to the outside. This is a particularly acute problem in geographic locations where winters are very cold. In extreme temperature conditions, the temperature gradient between the inside and outside of a building is quite extreme.

The solution proposed when aluminum is used has been to provide a thermal break in order to inhibit thermal conduction. Doing this, however, has translated to high manufacturing costs.

It is to these dictates of the prior art and the problems discussed above that the present invention is directed. It is a composition for a sliding door sill which overcomes the problems of the prior art, taking into account the desirable dictates for such a product.

SUMMARY OF THE INVENTION

The present invention is a door sill having a particular composition. The sill includes a core which defines a form. The form is made from spun glass fibers which are treated with a polyester resin. The form thus formed is, in turn, coated with an ultraviolet stable cladding.

In one embodiment of the invention, the core form includes a plurality of vertically-oriented spun glass fiber panels. The vertically-oriented panels are, in turn, integrated by a plurality of interconnecting panels.

In certain embodiments of the invention, the form can include an unsupported cantilevered portion. Such a portion, it would be intended, would extend outwardly from a building in which the sill is installed. Because of the strength properties afforded to the sill, the cantilevered portion could, in fact, be unsupported.

In the preferred embodiment, the core form would include glass fibers oriented both in lineal rows and random mats. The form thus constructed would provide flexing strength during vertical load over the length of the sill. The random mat would contribute strength against bending in the vertical plane. As a result, the need for a sill nose support would be eliminated.

The preferred embodiment also envisions employment of an ultraviolet stable sheathing. It is felt that a sheathing made of a material such as LEXAN would be optimum since such a material is not only ultraviolet stable, but it is also resistent to impact and abrasion. LEXAN® is a registered trademark of the General Electric Corporation.

Other claddings are, however, contemplated. Other appropriate claddings would, further, include the characteristics of a polycarbonate.

The present invention is thus an improved sill composition and construction. More specific features and advantages obtained in view of those features will become apparent with reference to the DETAILED DESCRIPTION OF THE INVENTION, appended claims, and accompanying drawing figures.

BRIEF DESCRIPTION OF THE DRAWING

The FIGURE is an end perspective view of a door sill constructed in accordance with the present invention.

DETAILED DESCRIPTION OF THE INVENTION

Figure 1:
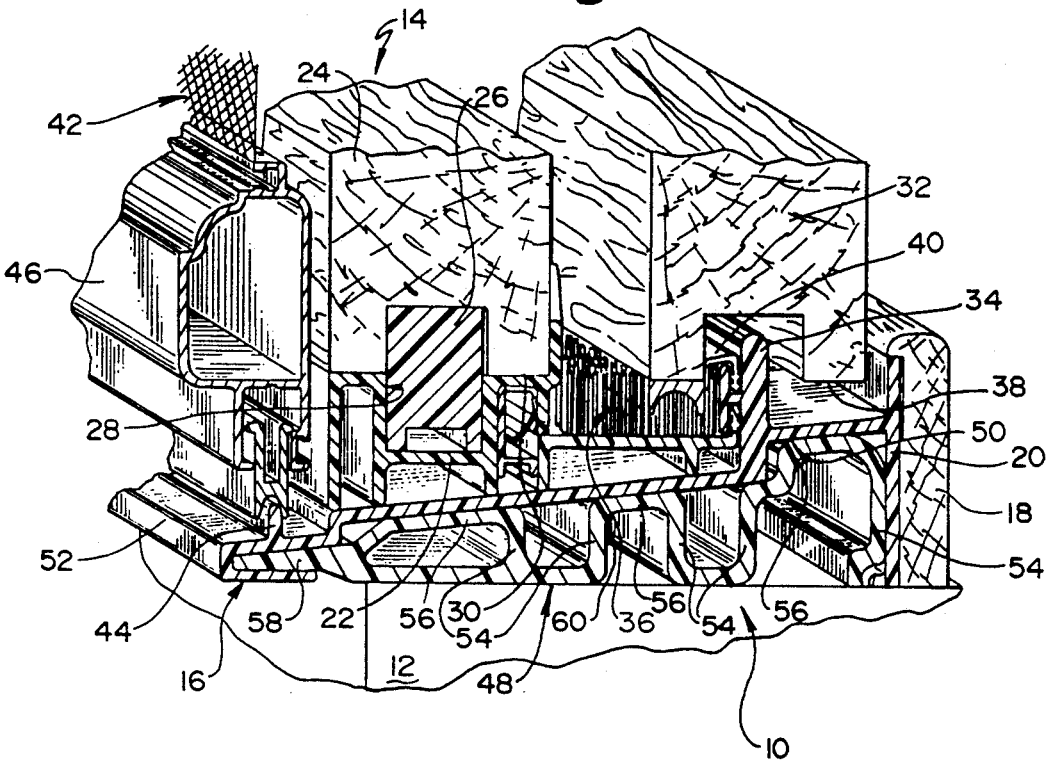

Referring now to the drawing wherein like reference numerals denote like elements throughout the several views, the FIGURE illustrates a door sill 10 composed in accordance with the present invention. While the overall sill 10 will be described in order to provide the general background and environment in which the present invention functions, it will be understood that the specific focus of the invention is the sill structure itself.

The FIGURE illustrates a sill 10 in position on a block 12 of a building in which a sliding door assembly, of which the sill is a part, is installed. The sill assembly 14 is seated on the block 12 with a cantilevered portion 16 of the sill 10 extending outwardly from the block 12. A baseboard 18 is in engagement with a generally vertically-extending inner panel 20 of the sill 10.

The overall sill 10 supports an extrusion 22 which mounts a fixed door panel 24. The door panel 24 is secured to the extrusion 22 by means of a block 26 which is received within a channel 28 formed within the lower edge 20 of the fixed door panel 24.

A sliding door panel 32 is mounted to a track 34 for longitudinal movement therealong, between open and closed dispositions. A pile seal is 36 engaged by the bottom edge 38 of the sliding door panel 32 to insulate, when the door panel 32 is in a closed disposition, the inside of the building in which the door 14 is mounted, from the exterior. Additionally, a weather seal strip 40 is mounted to the track 34 along which the sliding door panel 32 moves to seal along the bottom edge 38 of the sliding door panel 32 when that panel 32 is in its closed disposition.

The FIGURE also illustrates a sliding screen door 42 mounted to a track 44 extending upwardly from a cantilevered portion 16 of the sill structure 10. In fact, the screen door 42 is, typically, suspended by an upper rail thereof (not shown) from an upper track (not shown). The lower rail 46 of the screen door panel 42 interfaces with the lower track 34 merely for alignment purposes and to inhibit the passage of mud, snow, ice, etc.

As seen in the FIGURE, the sill structure 10 comprises two components, a core 48 and a cladding 50. The core 48 primarily functions to provide structural integrity, rigidity, and strength to the sill 10. The cladding 50 functions primarily to present a surface 52 exposed to the elements and which is protective against those elements. Typically, the cladding 50 is impact and abrasion resistant. Further, it is ultra-violet stable in view of the fact that the sill 10 is usually exposed to solar radiation.

The core 48 in accordance with the present invention is formed from spun glass fibers. Those fibers are treated with a resin binder. Shape is given to the core 48 by manufacturing it through a process known as "pultrusion". The process is similar to extrusion, but the thrust of the force is applied to draw the item through the die from a side of the die after the item has been formed. This is a corollary to a standard extrusion process.

The core 48 comprises a form which includes a plurality of generally vertically-oriented panels 54 which provide support in a vertical plane. The generally vertically-oriented panels 54 are interconnected by a series of transverse panels 56, the core 48 thereby being provided with form and shape.

The core 48 includes a generally horizontally-disposed cantilever portion 58. The core 48 cantilever portion 58 serves as a foundation for the overall cantilver portion 16 of the sill 10.

In the preferred embodiment of the invention, the core 48 includes glass fibers which are oriented both in lineal rows and random mats. A core so constructed provides flexing strength during vertical load over the length of the sill 10. The fibers formed into a random mat function to contribute strength against bending in the vertical plane. That is, they provide strength against torque forces applied, for example, to the cantilever portion 16 of the sill 10. Because of the random fiber matting, the cantilever portion 16 of the sill 10 need not be supported.

The sill further includes a cladding 50 which coats the core 48. It is important that the cladding 50 provide ultraviolet stability so that chemical breakdown does not occur. Further, the cladding 50 should be resistant to both impact and abrasion. Typically, any material having characteristics of a polycarbonate could appropriately function as the material for the cladding 50. It has been found, however, that LEXAN® is particularly appropriate to function for this purpose. It will be understood, however, that metals can, additionally, be appropriately used as the cladding material. Metals, however, because of their high thermal conductivity, are less desirable.

As seen in the FIGURE, the inner surface 60 of the cladding 50 generally conforms to a shape defined by various panels 56 of the core 48. The cladding 50 can, thereby, be fitted closely over the core 48 and be made substantially an integral structure.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined in the language in which the appended claims are expressed.

What is claimed is:

1. A door sill for seating on a foundation support of a building in which the sill is to be installed, the sill including, when it is installed seated on the foundation support, a portion cantilevered outward from a forward face of the foundation support, the sill comprising:

(a) a strengthening core having a dimension perpendicular to an axis of elongation of the foundation support, said perpendicular dimension being defined in part by a core cantilever portion which extends along, and forms, a forward edge of said core, said core being formed of spun glass fibers, oriented in both lineal rows and random mats, defining a plurality of vertically-oriented panels integrated by a plurality of generally horizontally-oriented interconnecting panels, at least one of which interconnecting panels is integrally formed with said core cantilever portion, wherein said core is strengthened along said full perpendicular dimension against flexure forces brought to bear upon the sill by persons stepping on the sill; and (b) an ultraviolet-stable, abrasion-resistant cladding, which has a low coefficient of thermal conductivity, encasing said core on at least upwardly-facing surfaces thereof.

2. A door sill in accordance with claim 1 wherein said cladding is made of a polycarbonate.

* * * * *